US005281050A

United States Patent [19]

Howard

[11] Patent Number: 5,281,050

[45] Date of Patent: Jan. 25, 1994

[54] POWER SCREED

[76] Inventor: Ronald M. Howard, 8631 E. Rosecrans Ave., Suite E, Paramount, Calif. 90723

[21] Appl. No.: 881,465

[22] Filed: May 11, 1992

[51] Int. Cl.[5] ..... E04G 21/10; E01L 19/42

[52] U.S. Cl. ..... 404/120

[58] Field of Search ..... 404/97, 114, 120, 118

[56] References Cited

U.S. PATENT DOCUMENTS

| | | | |
|---|---|---|---|
| 3,256,788 | 6/1966 | Schweihofer et al. | 404/120 |
| 3,883,259 | 5/1975 | Berg et al. | 404/120 |
| 4,213,749 | 7/1980 | Morrison | 404/120 X |
| 4,340,351 | 7/1982 | Owens | 404/120 X |
| 4,591,291 | 5/1986 | Owens | 404/118 |
| 4,838,730 | 6/1989 | Owens | 404/120 X |

OTHER PUBLICATIONS

Brochure, "Allen Engine Driven Screed" by Allen Engineering Corporation, 1982, entire document.

Brochure, "Allen Razorback Heavy Duty Vibratory Air Screed" by Allen Engineering Corporation, 1982, entire document.

Brochure, "Bit-Well Concrete Pavers" by Bid-Well, a Division of CMI Corporation, 1991, entire document.

Brochure, "Self Propelled Concrete Roller Screeds" by J. D. Concrete Screed, May 1, 1991, entire document.

*Primary Examiner*—William P. Neuder

*Attorney, Agent, or Firm*—Lyon & Lyon

[57] ABSTRACT

A power screed for striking off concrete or other substances using rods which reciprocate along their long axes at between about one and one hundred cycles per second, inclusive. The rods may be adapted to individual jobs from standard dimensioned lumber or from other materials.

19 Claims, 1 Drawing Sheet

POWER SCREED

FIELD OF THE INVENTION

The present invention relates to concrete finishing.

DESCRIPTION OF THE PRIOR ART

In the construction of a roadway, driveway, sidewalk or other surfaces, concrete or some other substance is generally deposited in a plastic state between two or more forms. In the case of concrete, the concrete is leveled off with the use of a rod to produce a relatively flat surface in a process called "knocking down", "rodding off", or "striking off" the concrete. While the relevant terms have several different meanings in the industry, a "screed" is understood to be a device adapted for striking off concrete. The term "rod" is reserved for a member drawn across wet concrete in the striking off process.

Striking off can be performed by hand, by a concrete finishing machine, or by some combination of the two. When striking off is performed by hand, an individual generally positions himself in the wet concrete, sets a rod on the top surface of the form, and levels small sections of concrete by successively drawing the rod towards him. The process is extremely tiring, particularly for the back, and poses a risk of abrasions, burns and rashes resulting from concrete splashing on the face and hands. Once the initial striking off is completed, additional steps of tamping and bull floating are usually necessary to provide a nominally smooth surface prior to final finishing. This involves running a flat object such as a bull float or a darby across the top surface of the concrete to cause the heavier aggregate to settle and the lighter matrix to rise to the surface.

Striking off has been mechanized by devices known in the art as power screeds or concrete pavers. There are three basic types of power screeds in common use: roller screeds, vibrating screeds and auger screeds.

In roller screeds, a large cylindrical rod is drawn across plastic concrete in a direction parallel to the form, and concurrently rotated about an axis perpendicular to the direction of motion. Although roller screeds have found acceptance in paving long, continuous slabs such as roadways, airport runways and canals, they have several drawbacks. Roller screeds are relatively large devices, often employing more than one multi-cylindered gasoline powered engine. The steel rollers, which may be over six inches in diameter, may weigh many hundreds of pounds. Even a roller screed using six foot rollers requires a special trailer to transport the screed from one job site to another, and may require special tracks or forms to support its own weight when in use. Operation of a roller screed requires specialized training, and there is a constant danger that the operator or other workmen will be injured in the mechanism. Roller screeds do not produce an especially smooth finish, and generally require follow-up floating. A high pressure wash down is usually required to clean roller screeds after use. This wastes water and energy, and involves additional hazard to the operator.

Vibrating screeds strike off concrete with the use of large, flat plates or blades which are typically powered by relatively high horsepower rated engines. These engines generally impart a vibration perpendicular to the concrete surface. Vibration is defined by the American Concrete Institute (ACI) in Manual SP-96 as a frequency between 7,500 and 10,000 cycles per minute for compaction and consolidation, (at least 125 cycles per second), and vibrating screeds generally operate at between 7,000 and 8,000 cycles per minute. Vibrating screeds are advantageous in that they are capable of producing a sufficiently smooth surface to reduce or eliminate subsequent tamping and floating. On the other hand, vibrating screeds are extremely heavy, unwieldy, noisy, and require more than one operator. As with roller screeds, vibrating screeds usually require a high pressure wash down step after use.

Auger screeds such as those sold under the Bidwell TM label use one or more augers suspended from a truss to strike off the concrete and a roller traveling behind the auger to smooth out the surface. They are heavy, unwieldy pieces of equipment, and are used in very specific applications such as bridge decks, highway and airport paving. They do not necessarily eliminate the need for floating, and they usually require a high pressure wash down.

Because of their size, weight, and expense, existing power screeds are poorly adapted for use on smaller projects such as driveways, patios, sidewalks, and in general building construction. They require specialized training to operate, special forms or guides to operate on, and in general, existing power screeds are not practical for large segments of the potential marketplace.

It is therefore an object and advantage of the present invention to provide a power screed which is readily adaptable to small and possibly atypical projects.

It is a further object and advantage of the present invention to provide a power screed which can be readily operated by a single person having little or no specialized training.

It is a further object and advantage of the present invention to provide a power screed which can be transported in an automobile, light truck or other non-specialized vehicle.

It is a further object and advantage of the present invention to provide a power screed which can be powered by a relatively small electric motor.

SUMMARY OF THE INVENTION

In the present invention, a power source other than human labor causes one or more rods to reciprocate back and forth along their lengths at a sub-vibrational frequency. While the rods are reciprocating, they are drawn across a mass of concrete or other substance set down in a space defined by a form. The reciprocating motion of the rods as they are drawn across the substance strikes off the substance and produces a smooth finish.

PREFERRED EMBODIMENTS

Figure 1:
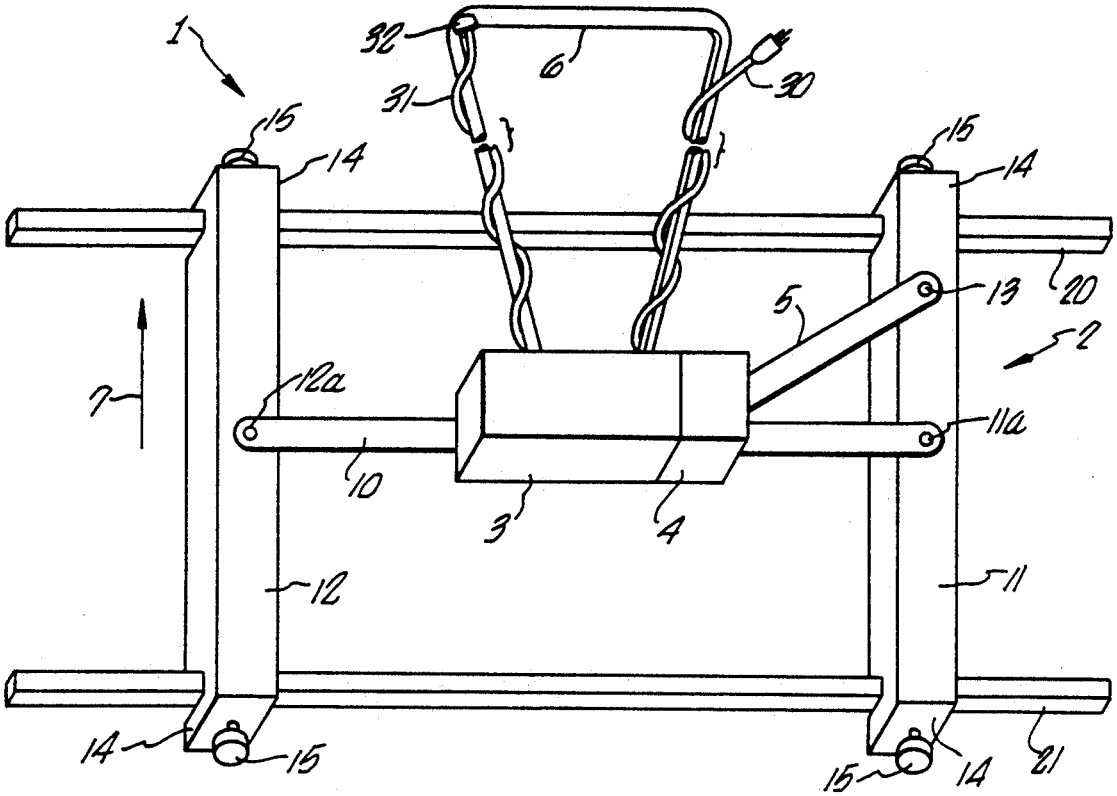
FIG. 1 is a perspective view of a screed according to the preferred embodiment.

In FIG. 1, a screed 1 generally comprises a frame 2, a motor 3, a conversion mechanism 4, a linkage 5, and a handle 6. The frame 2 is generally "I" shaped, comprising a motor support 10 and two spreaders 11, 12. The spreaders 11, 12 are attached to the motor support 10 at pivot points 11*a* and 12*a* respectively, and each spreader 11, 12 has two brackets 14 and thumb screws 15 for securing rods 20, 21. In this arrangement, the rods 20, 21 are mechanically coupled to each other.

When the motor 3 is running, it imparts power to the conversion mechanism 4. The conversion mechanism 4 causes the linkage 5 to alternately push and pull on spreader 11 at pivot point 13, which in turn causes the rods 20, 21 to reciprocate linearly back and forth in opposite directions with respect to each other. Concurrently with the rods 20, 21 reciprocating as described, the handle 6 is used to draw the frame 2 in the direction of arrow 7 across one or more forms (not shown) in which lies a mass of concrete (not shown). These motions strike off the concrete. Where the form defines a flat surface, the linear back and forth motion will be essentially horizontal.

The motor 3 is preferably electric, having power supplied through power cord 30. An electrically isolated power supply cord 31 leads to a switch 32 for varying the speed of the motor 3. While it is not absolutely necessary to be able to vary the frequency of reciprocation of the rods 20, 21, different reciprocating frequencies may be more preferable than others, depending in part upon the stroke of the linkage 5, the length of the rods 20, 21, the consistency of the concrete, and the technique of the operator.

Electric motors are generally considered to be preferable because they are quiet, inexpensive, lightweight, and have low maintenance requirements relative to other types of motors. Experimentation has shown that very small electric motors having as little as ¼ horsepower and below may be adequate for medium to light duty applications. Most job sites have utilities from which sufficient electric power can be drawn, and job sites not having sufficient utility power can use a suitable portable generating unit. Additionally, the invention should not be seen as being limited to electrically powered rotary motors. Any suitable means for powering the reciprocation of the rods 20, 21 could be used as the motor, including, for example, a linear electric motor, an internal combustion engine, a pneumatic, hydraulic or magnetic motor, or a simple piston.

Figure 2:
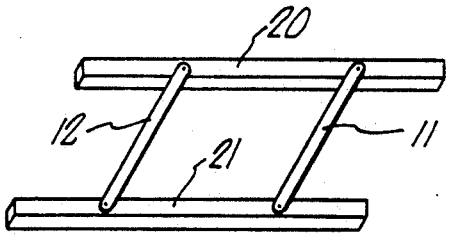
FIG. 2 is a schematic of one extreme of reciprocal motion of the rods.
Figure 3:
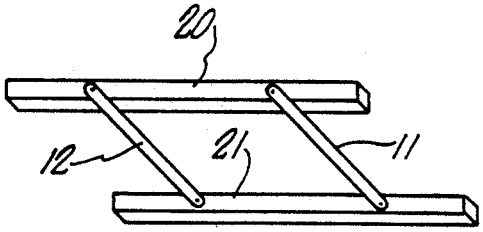
FIG. 3 is a schematic of the opposite extreme of reciprocal motion of the rods shown in FIG. 2.

FIGS. 2 and 3 schematically depict the rods 20, 21 at opposite extremes of reciprocal motion. Spreaders 11, 12 are included for reference. Although the rods 20, 21 are shown parallel to each other in FIGS. 1, 2 and 3, they may in practice be angled non-parallel relative to each other.

Figure 4:
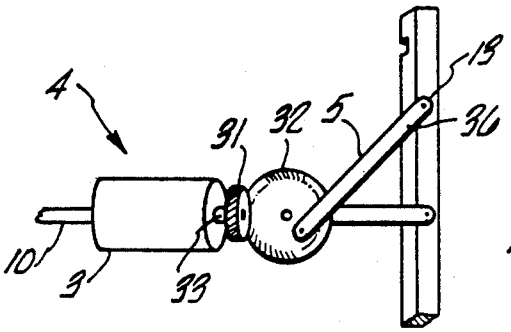
FIG. 4 is a schematic of a conversion mechanism and linkage.

In FIG. 4, the conversion mechanism 4 comprises a pinion 40 having a smaller gear 41 and a larger gear 42. Smaller gear 41 is attached to a rotating shaft 43 of motor 3. Larger gear 42 has an eccentric pintle 44 which receives one end 45 of link 5. The other end 46 of link 5 is attached to spreader 11 at pivot 13. When motor 3 is operating, the shaft 43 turns smaller gear 41, which turns larger gear 42, which in turn causes link 5 to rotate spreader 11 about pivot 11*a*. Due to the differences in sizes between gears 41 and 42, conversion mechanism 4 reduces the rotational speed of gear 42 relative to shaft 43. Depending in part on the rotational speed and power of motor 3, and the duty requirements of the task for which the screed 1 is being used, additional gears (not shown) may be necessary to further reduce the rotational speed of larger gear 42.

While a specific means of reciprocating the rods 20, 21 is thus disclosed, virtually any power means by which the rods 20, 21 can be reciprocated back and forth is intended to be encompassed herein. For example, the conversion mechanism 4 and linkage 5 may be any type of gearbox, pulley system, or other arrangement suitable for reciprocating rods 20, 21. In the case of a rotating motor 3, it may be necessary for the conversion mechanism 4 to reduce the rotational output of the motor 3 from several hundred revolutions per second down to a reciprocating frequency of not more than one hundred cycles per second. In the case of a pneumatic, hydraulic or other simple piston, the conversion mechanism 4 may be a non-existent. Other variations will be readily apparent to those skilled in the art.

Each of the rods 20, 21 can be comprised of dimensioned lumber in either standard sizes such as 2×4, 2×6 or 4×4, or in non-standard sizes. Other suitable material or materials such as metals, plastics or fiberglass may be substituted for wood or combined with wood, depending upon several factors including cost, length of the rods 20, 21, and consistency of the concrete being struck off. Standard dimensioned lumber is preferred because it is readily available and inexpensive, can be quickly and conveniently cut to whatever length is desired, and is readily disposed of after use. Standard 2×4s in lengths of six, eight, ten and twelve feet have been shown experimentally to be adequate for handling the normal range of slumps for flat slab concrete, which is considered to be three and one-half to six inches high, and contains aggregate up to one and one-half inches in diameter. Other circumstances may require rods of different sizes or rod materials. While the use of two rods is presently preferred, the use of a greater or lesser number of rods is also possible. For example, a single rod, could be suspended from a truss resting upon a form or guide. A three-rod screed could have two rods working in tandem with each other while the third rod reciprocates in opposition to the tandem rods.

The rods 20, 21 reciprocate at a relatively low, subvibrational frequency of between one and one hundred cycles per second, inclusive. Reciprocation at less than one cycle per second has been shown experimentally to be inadequate for striking off concrete and producing a smooth finish, and a frequency of greater than one hundred cycles per second begins to approach vibrational frequencies.

While the preferred embodiment of the screed 1 employs manual propulsion via pulling on the handle 6, other manual and power means of propulsion are intended to be encompassed herein. For example, a manual or power winch, wheels or even tracks may be employed to propel the screed. It will also be appreciated that although the screed 1 is generally pulled perpendicularly to the direction of reciprocation of the rods 20, 21, the screed may also be pulled at substantially any angle relative to the direction of reciprocation.

A device according to the preferred embodiment is particularly well adapted to small jobs because the rods 20, 21 can be made from 2×4 or other standard dimensioned lumber which is inexpensive, readily available, can be conveniently cut-to-size using standard power tools by a typical user at a typical job site, and can be disposed of in the same manner as other used lumber. For example, used rods 20, 21 can be incorporated into framing or employed in other construction related tasks. The use of disposable rods 20, 21 also eliminates the need for high pressure wash down.

A device according to the preferred embodiment can also be used for larger jobs because the rods 20, 21 can be readily obtained in lengths of up to twenty feet or more. For such jobs, larger or multiple motors may be employed, being restricted only by the practicalities of size, weight and power requirements. Despite this wide range of power and versatility, a screed without rods 20, 21 can weigh less than fifty pounds. This is well within the weight which can be carried by a normal user. A screed according to the preferred embodiment can thus fit easily into the back of a pickup truck. With its handle removed, a screed according to the preferred embodiment can also fit into the trunk of a compact automobile or job site tool box.

While the preferred embodiment has been described as using brackets 14 and thumb screws 15 to couple the rods 20, 21 to the frame 2, virtually any type of fastener is suitable as long as replacement of the rods 20, 21 is relatively convenient. This includes without limitation off-centered compression clamps, spring loaded clamps, hydraulic clamps, screws, bolts, and nails, each of which can be operated by a typical user at a typical job site.

Virtually all of the types of forms and guides currently in use with hand and power screeds can be used. These include standard edge forms, adjustable pipe type finish forms, and 2×4 forms preset to finish elevation. Notches or other special shapes (not shown) can be cut into the ends of the rods 20, 21 or otherwise provided to fashion a concrete surface below the level of the forms or guides, or for other special circumstances. Further, the bottom surface of the rods 20, 21 can be modified to produce a crown, swail, or other surface instead of or in addition to a flat plane.

A major advantage of a screed according to the preferred embodiment is that reciprocation of the rods 20, 21 at not more than one hundred cycles per second has been shown to produce a high quality floated finish suitable for final finishing. This reduces the work load associated with placing flat concrete, which in turn eases personnel requirements and costs. Further, striking off of concrete can be accomplished by a single worker while standing more or less erect. This reduces or eliminates back strain and the possibility of wet concrete splashing on the face, hands or other exposed areas.

A secondary advantage of a screed according to the preferred embodiment is that it may be utilized to strike off a variety of substances in addition to fresh concrete, including but not limited to peat moss, loose sand, pea gravel, soil, terrazzo surfacing, all types of floor toppings such as adhesives, patching products, and mortar, and generally any substance which can be struck off and finished.

Thus, a novel power screed and method of striking off concrete and other substances has been disclosed. While specific embodiments and applications of this invention have been shown and described, it will be apparent to those skilled in the art that many more modifications are possible without departing from the inventive concepts herein. The invention, therefore, is not to be restricted except in the spirit of the appended claims.

I claim:

1. A screed for mounting at least two rods, comprising:

a frame pivotally mounting the rods to reciprocate in opposing back and forth motions;

a power source mounted on said frame; and linkage coupled to the rods and said power source for moving at least two of the rods relative to said power source in said opposing back and forth motions at a frequency below 125 cycles per second.

2. The screed of claim 1 wherein the rods are comprised of standard dimensioned lumber.

3. The screed of claim 1 wherein said power source is a rotary electric motor.

4. The screed of claim 1 wherein said frame is generally "I" shaped, having a motor support member and two spreaders.

5. The screed of claim 4 wherein said linkage comprises a pinion including a smaller gear and a larger gear, and a link having two ends, said smaller gear connected to said power source and said larger gear having an eccentric pintle for receiving one end of said link, the other end of said link being connected to one of said spreaders.

6. The screed of claim 1 wherein said frame, power source and linkage have a combined weight of less than fifty pounds.

7. A power screed comprising:

a frame;

two rods having long axes, said rods pivotally coupled to said frame in such orientation that said long axes are parallel to each other;

power means operatively positioned on said frame to reciprocate said rods relative to said power source and relative to each other horizontally back and forth along said parallel long axes at a sub-vibrational frequency; and means for propelling said rods at an angle relative to said parallel long axes.

8. The screed of claim 7 wherein said rods are comprised of standard dimensioned lumber.

9. The screed of claim 7 wherein said power means comprises a rotary electric motor.

10. The screed of claim 7 wherein said means for reciprocating comprises a frame having a pivoting member, a pinion and a link, said pinion having at least two gears and said link linking one of said gears to said pivoting member.

11. The screed of claim 7 wherein said means for propelling comprises a handle.

12. A screed comprising:

at least two disposable rods having lengths which can be conveniently cut-to-size at a job site;

a frame of sufficiently light weight to be carried by a single user, said frame having fasteners for conveniently receiving and interchanging said rods;

a motor having sufficient power to linearly reciprocate said rods along said lengths at a rate of between about one and about one hundred cycles per second; and linkage coupled to said motor and said rods whereby said rods reciprocate oppositely with respect to each other, said rods pivot with respect to said frame, and said rods reciprocate with respect to said motor.

13. The screed of claim 7 wherein said rods are comprised of standard dimensioned lumber.

14. The screed of claim 7 wherein said motor comprises a rotary electric motor.

15. A method of striking off a substance contained within a form comprising the steps of:

setting a rod on said form;

mechanically reciprocating said rod back and forth lengthwise at a rate of between one and one hundred reciprocations per second, inclusive; and simultaneously drawing said rod along said form over said substance.

16. The method of claim 15 wherein the step of setting a rod on said form comprises manually lifting and placing said rod on said form.

17. The screed of claim 15 wherein the step of mechanically reciprocating comprises converting a rotary motion of a motor into said reciprocating motion of said rod

18. The screed of claim 17 wherein the step of mechanically reciprocating further comprises reciprocating a second rod oppositely to said rod.

19. The screed of claim 15 wherein the step of drawing said rod comprises pulling a frame upon which said rod is operatively mounted at an obtuse angle relative to said lengthwise reciprocation.

* * * * *